US005904063A

United States Patent [19]

Owens

[11] Patent Number: 5,904,063

[45] Date of Patent: May 18, 1999

[54] TUBE BEADING APPARATUS

[76] Inventor: Carl H. Owens, 5215 Phillips Hwy. #1, Jacksonville, Fla. 32207

[21] Appl. No.: 09/008,153

[22] Filed: Jan. 16, 1998

[51] Int. Cl.[6] ..... B21D 15/02

[52] U.S. Cl. ..... 72/316; 72/370.03; 72/370.06

[58] Field of Search ..... 72/316, 318, 370.06, 72/370.01, 370.03, 367.1, FOR 101

[56] References Cited

U.S. PATENT DOCUMENTS

| | | | |
|---|---|---|---|
| 378,414 | 2/1888 | Burkhardt | 72/370.03 |
| 1,889,775 | 12/1932 | Cornell | 72/318 |
| 3,866,457 | 2/1975 | Bagby | 72/370.03 |
| 4,980,961 | 1/1991 | Caudill | 72/316 |
| 5,782,128 | 7/1998 | Barjesteh | 72/318 |

FOREIGN PATENT DOCUMENTS

| | | | |
|---|---|---|---|
| 515745 | 12/1939 | United Kingdom | 72/318 |
| 770424 | 3/1957 | United Kingdom | 72/318 |
| 1086526 | 10/1967 | United Kingdom | 72/318 |

*Primary Examiner*—Daniel C. Crane
*Attorney, Agent, or Firm*—Thomas C. Saitta

[57] ABSTRACT

A tube beading apparatus for cold forming an annular external bead on a metal tube, the apparatus having a clamp to secure the tube, a beading die to form the bead and a powered ram to advance the die against the end of the tube. The beading die has a tube receiving channel surrounding a central mandrel which extends past the forward wall of the beading die, with the mandrel sized to fit into the bore of the tube to prevent deformation of the bore and with the tube receiving channel sized equal or smaller than the outer diameter of the tube, so that when the die is forced onto the end of the tube the tube wall is deformed into the annular bead. The shoulder of the clamp aperture holding the tube and the shoulder of the tube receiving channel are rounded to properly form the bead.

14 Claims, 2 Drawing Sheets

TUBE BEADING APPARATUS

BACKGROUND OF THE INVENTION

This invention relates generally to the field of devices which are used to impart an external annular or radial bead or shoulder to a hollow tube or pipe. More particularly, the invention relates to such devices utilizing a clamp to secure the tube, a beading die having an axial guide pin or mandrel surrounded by an annular tube receiving channel and means to mount the die onto a ram, whereby the die can be pressed against the end of the tube to force the tube against the clamp to produce the bead.

In many applications where gas or fluids need to be conducted through a tube, a fitting known as a bead/O-ring connection is used to seal the joint or connection between the tube and the component to which it attaches Such fittings are common in hydraulic, pneumatic and liquid systems. The normal production cycle in the industry is for the original equipment manufacturer (OEM), such as General Motors, Ford, Caterpillar to have the beaded fluid line assembly fabricated by a specialty fabrication vendor which specializes in the high speed high volume production of "blue-printed" fluid line assemblies that have the bead/O-ring seal configuration. Typical methodology for producing a beaded tube utilizes either a two-step procedure using one die to reduce the tube diameter and a second die to form the bead, or the use of rotary forming equipment. The beaded tube may be connected to the system several different ways, typically utilizing a mated male nut and female nut combination with the O-ring sealing any gap between the bead and one of the nuts. When the systems fail and a beaded tube connection needs to be replaced, it is usually necessary to obtain a replacement OEM tube. This often results in considerable delay before the equipment can be used again. The concept behind this invention is to provide a means for the duplication of traditional, highly specialized, high production, normally non-duplicatable, procedures at the after-market or repair shop level with inexpensive tooling that simplifies the process.

It is an object of this invention to provide an apparatus which enables formation of a beaded replacement tube of proper size from standard tube stock, obviating the need to locate an OEM replacement part. It is a further object to provide such an apparatus which utilizes a clamp to grasp the tube and provide a deformation backstop, a beading die having an axial mandrel which corresponds to the internal diameter of the tube being shaped and an annular receiving channel to receive the end of the tube, and a powered ram to advance a beading die against the tube and backstop to cold press the tube to form the radial bead in a single operation step.

SUMMARY OF THE INVENTION

The invention is an apparatus for cold forming a 360 degree annular or radial bead or shoulder onto the outside of a metal tube in a simple and efficient manner, the apparatus comprising in general a clamping means to secure the end of the tube, a beading die to form the bead, and powered ram means to advance the die against the tube end to form the bead on the tube in a single-step operation. The clamping means is mounted to a base and provides a deformation backstop which is the means to mold the side of the bead adjacent the clamp. The ram means can be any known drive means to move the beading die with sufficient force to deform the tube to create the bead, and may consist of hand operated mechanical means, such as a screw drive mechanism, but which is preferably hydraulically, pneumatically or electrically powered. The beading die comprises a main body with means to attach the die to the ram means, a mandrel or center pin which fits into the interior of the tube and extends a distance beyond the point at which the bead is to be formed, an annular tube receiving channel or recess coaxially surrounding the mandrel, and a forward wall. The shoulder of the clamp aperture and the shoulder of the tube receiving channel are rounded. To produce a bead on a tube, the tube is secured in the clamp aperture such that a short end segment of the tube extends from the clamp backstop and toward the beading die, both of which share a common central axis. The beading die is chosen such that the internal diameter of the tube receiving channel is the same size or smaller than the external diameter of the tube, while the external diameter of the mandrel is only slightly smaller than the internal diameter of the tube, thus allowing the mandrel to be inserted into the bore of the tube with the end of the tube abutted against the rounded edge of the tube receiving channel of the beading die. As the die is advanced toward the tube and clamp, the metal end of the tube is pressed into the tube receiving channel. As the tube receiving channel is filled with the tube, the combination of the die and clamp causes the tube to fold radially outward as the beading die is advanced, until it is compressed between the forward wall of the beading die and the deformation backstop of the clamp, resulting in an annular bead on the tube.

DETAILED DESCRIPTION OF THE INVENTION

Figure 1:
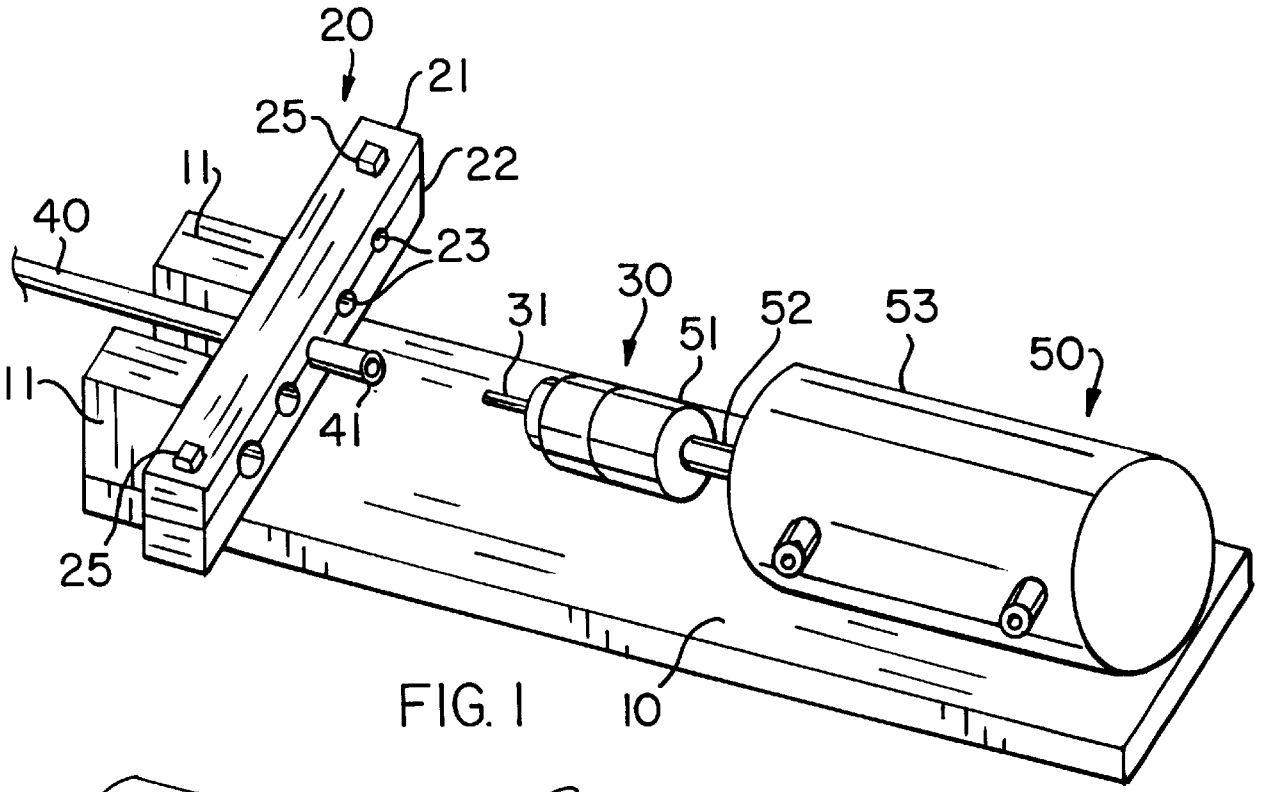
FIG. 1 is a perspective view of the invention showing the clamping means, tube, beading die, ram means and base member.

With reference to the drawings, the invention will now be described in detail with regard for the best mode and the preferred embodiment. In general, as seen in FIG. 1, the invention is a tube beading apparatus comprising clamping means 20 and ram means 50 attached to a base member 10, with a beading die 30 connected to the ram means 50. The clamping means 20 secures a tube 40, with the tube 40 and beading die 30 coaxially aligned such that the beading die 30 can be advanced axially against the end 41 of tube 40.

The base member 10 may be composed of any suitable material, preferably metal, which allows for attachment of or to the ram means 50. Means to secure the clamping means 20, shown as clamp braces 11, are provided on the base member 10 such that the clamping means 20 and the ram means 50 remain a fixed distance apart during the bead forming operation. The ram means 50 may be any suitable power means capable of delivering sufficient force to advance the beading die 30 against the tube 40 to deform the metal to form an annular bead 44. For example, the ram means 50 may be hydraulically, pneumatically or electrically powered, or may even be hand powered utilizing a mechanical screw mechanism or the like. As shown in FIG. 1, the ram means 50 is preferably an hydraulically powered piston 53 which linearly reciprocates a ram or rod 52 having die mounting means 51 attached to its end. The die mounting means 51 may be of various types or configurations, provided that the die mounting means 51 in conjunction with the ram mounting means 37 of beading die 30 provides a means to releasably secure the beading die 30 to the ram means 50, thereby allowing the beading die 30 to be interchanged with other beading dies 30 of differing sizes.

The clamping means 20 may comprise any suitable means for securing the tube 40 in fixed relation to the base member 10 so that the tube end 41 remains stationary when the beading die 30 is advanced, provided that the side of the clamping means 20 facing the beading die 30 is properly configured to form the bead 44 on the tube 40. As shown, the clamping means 20 comprises a first member 21 and a second member 22, each of which have corresponding semicircular cut-outs which upon alignment of the first and second members 21 and 22 form tube gripping apertures 23. The tube apertures 23 are of different sizes corresponding to standard tube sizes, enabling the clamping member 20 as shown to be used with any of five different tubes 40. Each portion of tube apertures 23 encompasses slightly less than 180 degrees, such that when the clamping means 20 is closed and the two members 21 and 22 are pressed together about tube 40 by locking means 25, here shown as threaded bolts, a small gap is present between the two members 21 and 22 and the tube 40 is securely gripped such that any movement relative to the clamping means 20 in the axial direction is prohibited. The side of the clamping means 20 facing the beading die 30 is formed as a generally planar surface which comprises a deformation backstop or wall 26, which during formation provides a mold or form for one side of the annular bead 44. The aperture shoulder 24 between the tube aperture 23 and the backstop wall 26 is a rounded radial edge so that the bead 44 properly forms with no sharp angles, corners or edges at the junction with the tube 40, which could cause splitting or failure of the bead 44 either during formation or use.

Figure 2:
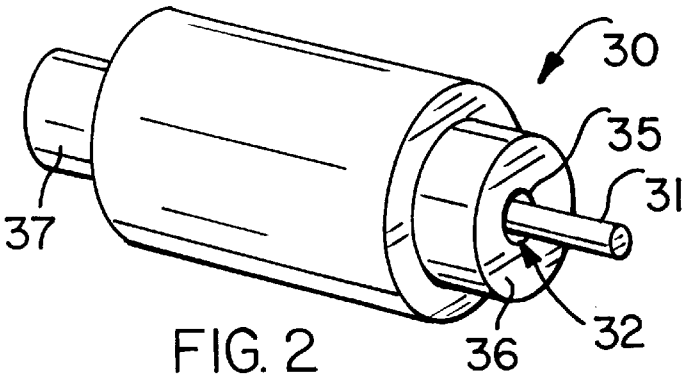
FIG. 2 is a perspective view of the beading die as removed from the ram means.
Figure 3:
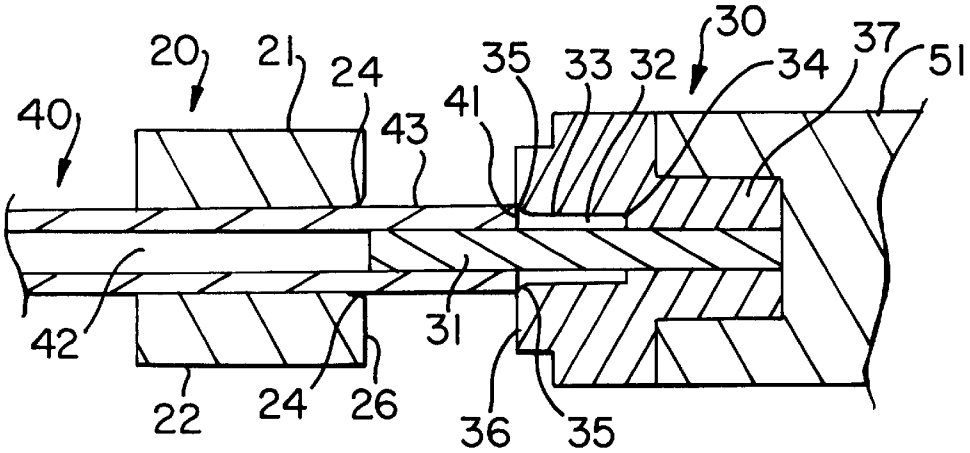
FIG. 3 is a cross-sectional view showing the relative positions of the clamping means, tube end and beading die prior to bead formation.
Figure 4:
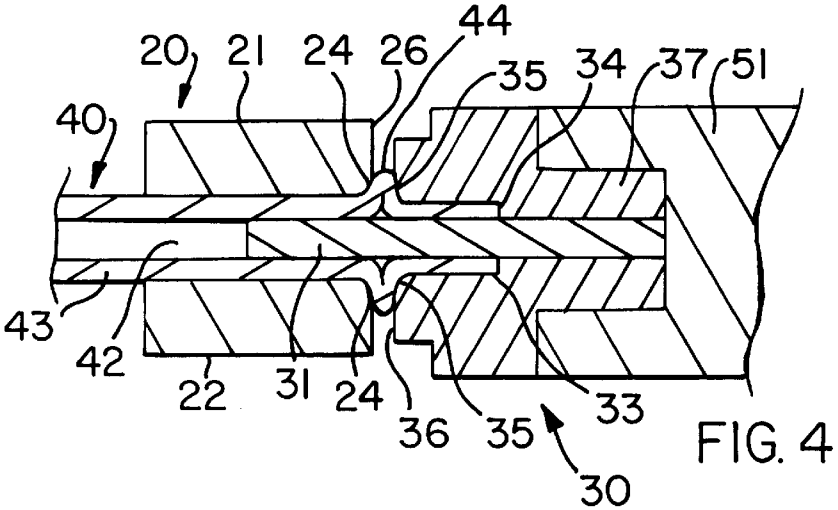
FIG. 4 is a cross-sectional view similar to FIG. 3 showing the relative positions of the clamping means, tube end and beading die after formation of the bead on the tube.

The beading die 30, as seen best in FIGS. 2 through 4, comprises ram mounting means 37 for connecting in releasable fashion the beading die 30 to the die mounting means 51 of ram means 50, and is shown as a cylindrical member which fits into a socket on the die mounting means 51. A tightening screw, not shown, or other means to temporarily secure the beading die 30 to the ram means 50 may be provided. The main body of beading die 30 comprises an annular tube receiving channel or recess 32 having an annular wall 33 and an internally positioned, generally planar, end or wall 34 which creates a stop for the tube end 41 during bead formation. The forward wall 36, the side of beading die 30 facing the tube end 41, is generally planar and acts as the second form or mold for the bead 44 during formation. In conjunction with the deformation backstop wall 26 of the clamping means 20, the forward wall 36 of the beading die 30 produces a bead 44 having generally planar and parallel side walls. The channel shoulder 35 at the junction of the tube receiving channel 32 and forward wall 36 is a rounded radial edge, rather than angled or bevelled corner, to insure that the bead 44 will have a rounded junction with the tube 40 in the same manner as the clamp aperture shoulder 24. Coaxially positioned within the tube receiving channel 32 is a cylindrical mandrel or pin member 31, which extends a distance beyond the forward wall 36 as shown in the figures. The mandrel 31 may be press-fit into the main body of beading die 30, attached by suitable fastening means or the beading die 30 with mandrel 31 may be machined out of a single piece. The combination of the outer surface of the mandrel 31, the annular wall 33 and end 34 of tube receiving channel 32 define a tubular recess with a closed end for receipt of the tube end 41 during the beading operation.

To create a bead 44 on a tube 40, the tube 40 is secured within clamping means 20 such that a short segment of tube end 41 extends toward beading die 30 in coaxial alignment, as shown in FIG. 1. With beading die 30 mounted onto the ram means, beading die 30 is advanced toward tube end 41 such that the mandrel 31 is inserted into tube end 41, as shown in FIG. 3. The dimensions of beading die 30, and in particular the outer diameter of mandrel 31 and the inner diameter of annular wall 33 of tube receiving channel 32, are determined by the inner and outer diameters of tube 40. The outer diameter of mandrel 31 should be chosen only slightly smaller than the inner diameter of tube 40, with the difference being the minimum amount necessary to allow the mandrel 31 to be inserted into bore 42 of tube 40. Mandrel 31 acts as the internal stop means to prevent inward deformation of the bore 42 during bead formation, so that the internal diameter of the tube 40 is unchanged after bead formation. The inner diameter of annular wall 33 of the tube receiving channel 32 is chosen to be equal to or preferably slightly smaller than the outer diameter of tube 40, and the distance between the inner diameter of annular wall 33 and the outer diameter of mandrel 31 is equal to or smaller than the thickness of tube wall 43. With the smaller dimensions chosen, the tube end 41 abuts against the radial channel shoulder 35 with mandrel 31 extending a distance into bore 42, but further advancement of the beading die 30 is not possible without some cold deformation of the material of tube 40.

As the ram means 50 is activated to fully advance the beading die 30 against the tube end 41, an annular portion of the metal forming the outside of tube wall 43 may be sheared or rolled from the outer surface of tube 40, while the interior portion of the metal in tube wall 43 is inserted into tube receiving channel 32, as seen in FIG. 4. When the beading die 30 is fully advanced, an annular or radial bead 44 is formed around the full circumference of tube 40 between the deformation backstop 26 of clamping means 20 and the forward wall 36 of beading die 30, the bead 44 having generally planar side walls, a rounded top and rounded junctions with the outside of tube 40. The segment of tube wall 43 between the bead 44 and the tube end 41 will have the same inner diameter as the remainder of the tube 40 due to the presence of mandrel 31, but this segment will have a thinner tube wall 43 if the diameter of the annular wall 33 of tube receiving channel 32 is smaller than the original outer diameter of tube 40. The annular bead 44 is produced by a folding action controlled by the aperture shoulders 24 and the deformation backstop 26 and the channel shoulders 35 and the forward wall 36 of the beading die 30. The beading die 30 is then retracted and the beaded tube 40 removed from clamping means 20 for use.

It is contemplated that certain equivalents and substitutions to elements set forth above may be obvious to those skilled in the art, and therefore the true scope and definition of the invention is to be as set forth in the following claims.

I claim:

1. A tube beading apparatus for cold forming an annular bead on a metal tube, the apparatus comprising:

(A) clamping means to secure a metal tube in coaxial alignment with a beading die, said clamping means comprising a tube aperture to receive the tube and a deformation backstop having a generally planar surface, said tube aperture and said deformation backstop joined by a rounded shoulder;

(B) a beading die to deform the tube to form an annular bead, said beading die comprising a tube receiving channel having an annular wall and an end, a forward wall having a generally planar surface, said tube receiving channel and said forward wall joined by a rounded shoulder, and a cylindrical mandrel aligned coaxially within said tube receiving channel and extending beyond said forward wall; and (C) ram means to advance said beading die against the tube to cold form an annular bead on the tube in a single step, where the mandrel is inserted into the tube and a portion of the tube is forced into the tube receiving channel and the annular bead is formed by and against the rounded shoulders of the beading die and clamping means.

2. The apparatus of claim 1, where said ram means is powered hydraulically.

3. The apparatus of claim 1, where said ram means is powered pneumatically.

4. The apparatus of claim 1, where said ram means is powered electrically.

5. The apparatus of claim 1, where said ram means is manually powered.

6. The apparatus of claim 1, where said clamping means and said ram means are attached to a base member.

7. The apparatus of claim 1, where the outer diameter of said mandrel is only slightly smaller than the diameter of said tube bore and where the distance between said annular wall of said tube receiving channel and said mandrel is smaller than the thickness of the tube.

8. A tube beading apparatus for cold forming an annular bead on a metal tube, the apparatus comprising:

(A) a metal tube having an end, a wall and a bore;

(B) clamping means to secure said tube in coaxial alignment with a beading die, said clamping means comprising a tube aperture to receive said tube and a deformation backstop having a generally planar surface, said tube aperture and said deformation backstop joined by a rounded shoulder;

(B) a beading die to deform said tube to form an annular bead, said beading die comprising a tube receiving channel having an annular wall and an end, a forward wall having a generally planar surface, said tube receiving channel and said forward wall joined by a rounded shoulder, and a cylindrical mandrel aligned coaxially within said tube receiving channel and extending beyond said forward wall; and (C) ram means to advance said beading die against said tube to cold form an annular bead in a single step, where the mandrel is inserted into said tube bore and a portion of said tube wall is forced into the tube receiving channel and the annular bead is formed by and against the rounded shoulders of the beading die and clamping means.

9. The apparatus of claim 8, where the outer diameter of said mandrel is only slightly smaller than the diameter of said tube bore and where the distance between said annular wall of said tube receiving channel and said mandrel is smaller than the thickness of said tube wall.

10. The apparatus of claim 8, where said ram means is powered hydraulically.

11. The apparatus of claim 8, where said ram means is powered pneumatically.

12. The apparatus of claim 8, where said ram means is powered electrically.

13. The apparatus of claim 8, where said ram means is manually powered.

14. The apparatus of claim 8, where said clamping means and said ram means are attached to a base member.

* * * * *